United States Patent [19]

Martin et al.

[11] 3,980,008

[45] Sept. 14, 1976

[54] LADLE CANOPY

[75] Inventors: Robert W. Martin, Rock Falls; Kenneth L. Ernst, Dixon, both of Ill.

[73] Assignee: Northwestern Steel and Wire Company, Sterling, Ill.

[22] Filed: Dec. 2, 1974

[21] Appl. No.: 528,947

[52] U.S. Cl. ..... 98/115 VM; 202/263; 141/93

[51] Int. Cl.[2] ..... B65B 3/18

[58] Field of Search ..... 141/93, 97, 392, 285, 141/59; 202/207, 263; 266/15–19; 98/115 R, 115 VM; 122/7 A; 104/52

[56] References Cited

UNITED STATES PATENTS

| | | | |
|---|---|---|---|
| 1,200,331 | 10/1916 | Filkins | 104/52 |
| 2,260,441 | 10/1941 | Day et al. | 104/52 |
| 2,855,194 | 10/1958 | König | 98/115 VM |
| 3,096,704 | 7/1963 | Russell | 141/93 |
| 3,380,371 | 4/1968 | Scheel | 98/115 |
| 3,533,611 | 10/1970 | Boyer et al. | 266/15 |
| 3,818,817 | 6/1974 | Nederman | 98/115 VM |

*Primary Examiner*—Houston S. Bell, Jr.
*Attorney, Agent, or Firm*—Hill, Gross, Simpson, Van Santen, Steadman, Chiara & Simpson

[57] ABSTRACT

A ladle canopy for venting gases during pouring of the molten contents of a furnace into a ladle which includes a frame, a plurality of individual curtain walls depending from the frame and arranged to be received over the ladle, a duct connected to the frame for receiving the gases in the canopy, the duct being releasably connected to a stationary duct system which communicates with a source of reduced pressure, the entire canopy and the associated duct being arranged for pivotal movement with respect to the ladle so that the entire canopy assembly can be swung into and out of ladle covering position.

7 Claims, 3 Drawing Figures

LADLE CANOPY

BACKGROUND OF THE INVENTION

1. Field of the Invention

This invention is in the field of devices for removing fumes and the like directly in the vicinity of the ladle as molten metal is being poured therein and includes a canopy device for swinging into and out of superimposed relation with the ladle to collect fumes at the source and direct them more efficiently to a fume collecting and disposal dystem.

2. Description of the Prior Art

Most plants having tiltable steel making electric furnaces provide rather substantial fume collection apparatus to prevent the fumes from being discharged in the atmosphere. Some of these disposal systems include very large canopy hoods which are located above the furnace as a permanent fixture. Generally, these permanent fixture hoods are located in the rafters of the building and require large amounts of energy for their proper and efficient operation due to the large volumes of air which are drawn into the hoods along with the emissions. Even at their most efficient operation, however, the permanent canopy hoods cannot collect all of the emissions occurring during pouring of the molten metal since they are subject to wind currents which divert the fumes from the canopy.

SUMMARY OF THE INVENTION

The present invention provides a ladle canopy for venting gases during pouring of molten metal from a furnace, the canopy being arranged for pivotal movement into and out of superimposed relationship with the ladle. The canopy consists of a rigid frame from which a plurality of individual curtain walls depend, the curtain walls being hingedly connected to the frame.. The frame has a duct connected to it with a releasable seal connecting the duct to a stationary exhaust conduit which directs the collected fumes to pollution control equipment such as a scrubber or the like. The canopy, in use, is positioned reasonably close to the point at which the fumes are generated so that the emissions are captured substantially at their source. Through the use of the canopy of the present invention, the visual signs of emission are substantially reduced. Furthermore, with the use of the canopy of the present invention, it is not necessary to use as large a fume handling system because the more concentrated gases are picked up and disposed of before they can come in contact with air and become diluted. This, therefore, results in a substantial reduction in energy consumption.

BRIEF DESCRIPTION OF THE DRAWINGS

Other objects, features and advantages of the invention will be readily apparent from the following description of certain preferred embodiments thereto, taken in conjunction with the accompanying drawings, although variations and modifications may be effected without departing from the spirit and scope of the novel concepts of the disclosure, and in which.

DESCRIPTION OF THE PREFERRED EMBODIMENTS

Figure 1:
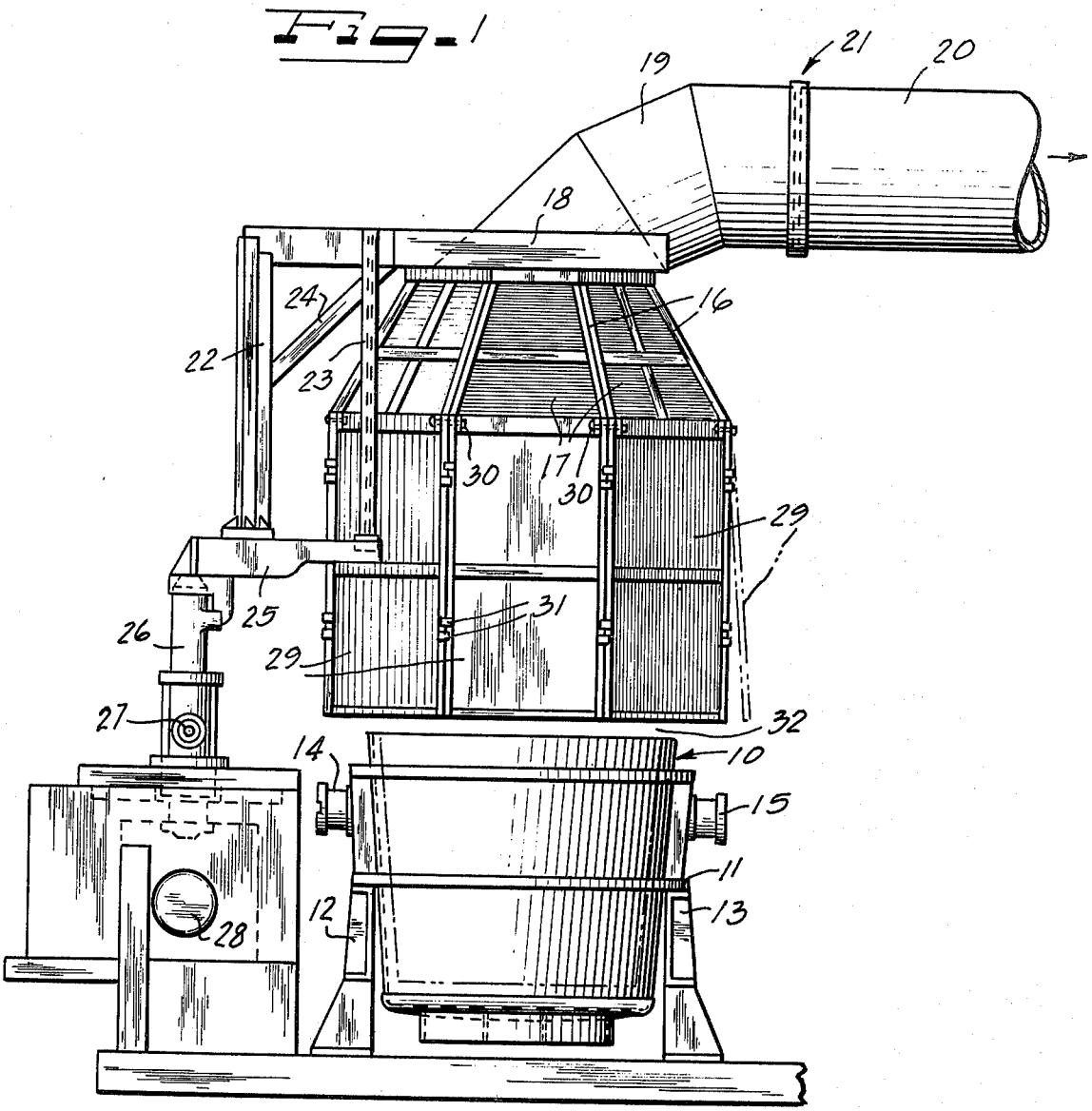
FIG. 1 is a view in elevation of the improved ladle canopy of the present invention.

In FIG. 1, there is illustrated a conventional ladle 10 positioned for receiving a molten metal, and including a flange 11 which rests upon a pair of opposite piers 12 and 13. A pair of lugs 14 and 15 on opposite sides of the ladle 10 provide means for a crane to deposit the ladle 10 in metal receiving position or to remove it after pouring has been completed.

The canopy structure itself includes a rigid framework consisting of inclined spacing members 16 joined together by solid metal plates 17. The framework 16 is secured within a collar 18 which also carries a duct 19. The duct 19 is connected to a stationary duct 20 by means of a releasable seal 21, the details of which will be described in a succeeding portion of this specification.

The collar 18 is supported in cantilever fashion from rigid support arms 22 and 23, with an angular brace 24 extending to the collar 18. The support arms 22 and 23 are rigidly secured to a support 25. The entire assembly is pivotally mounted by being secured to a shaft 26, the pivotal movement being accomplished by the provision of a hydraulic cylinder 27 driven by a motor 28.

A plurality of curtain walls consisting of panels 29 is hingedly secured from the frame by means of hinges 30. Tabs 31 on each of the adjoining panels 29 prevent the panels from swinging too far inwardly as the canopy is being moved into position over the ladle 10. Some air is aspirated into the canopy from a space 32 which is located between the bottom of the canopy structure and the top of the ladle 10, but the spacing is such that this amount of air is minimized.

Figures 2, 3:
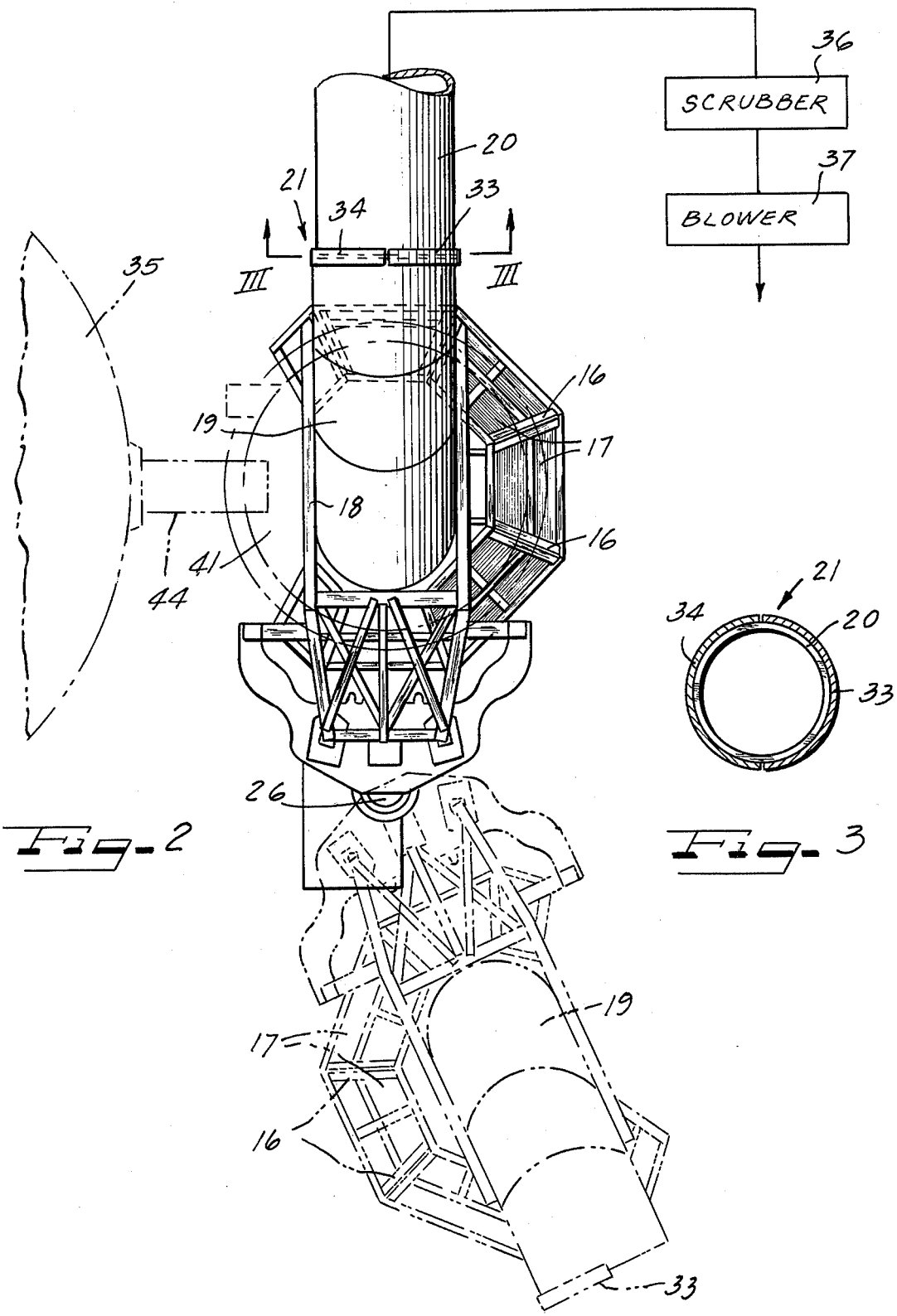
FIG. 2 is a plan view of the canopy illustrating the pouring position in the solid lines, and the retracted position of the canopy in the dash lines.
FIG. 3 is a cross-sectional view of the seal element taken substantially along the line III—III of FIG. 2.

As best illustrated in FIG. 2, the canopy is provided with an opening 41 devoid of panels 29 and which is arranged to receive a pouring spout 44 associated with a tilting electric furnace 35.

The gas tight seal 21 which is provided between the duct 19 and the stationary duct 20 may consist of two semicircular sections 33 and 34, as best illustrated in FIG. 3. Each section 33 and 34 may consist of a plate which is welded about half the periphery of the corresponding duct, which sections mate when the ladle canopy is swung into the position shown in solid lines in FIG. 2.

The stationary duct 20 delivers the fumes to pollution control equipment such as a scrubber 36. A large blower 37 is provided to move the air and fumes from the canopy into the duct 19, and thereafter into the pollution control equipment through the stationary duct 20.

It is believed that the improved canopy of the present invention picks up at least 80% of the smoke and fumes which emanate during pouring of the electric furnace. The average temperature of the fumes is about 300°F (149°C). The blower is of sufficient size so that the fumes at the ladle are diluted in a ratio of about 2 to 1 with air before they pass through the pollution controlled equipment.

The ladle canopy of the present invention provides a significant improvement in control of fumes because it captures the emissions directly at the source. Through the use of the canopy of the present invention, the need for large fume handling systems is obviated because the emissions are captured when they are in concentrated form. The canopy of the present invention is insensitive to wind currents so that a far more efficient collection of fumes and gases occurs.

It should be evident that various modifications can be made to the described embodiments without departing from the scope of the present invention.

We claim as our invention:

1. A ladle canopy for venting gases during pouring of the molten contents of a furnace into a ladle comprising a frame, a plurality of individual curtain walls in side-by-side relation individually supported by and depending from said frame and arranged to be received above the periphery of said ladle, a duct connected to said frame for receiving said gases, means for drawing said gases into said duct, and means for pivotally mounting said frame to swing the same into and out of ladle covering position.

2. The canopy of claim 1 in which the bottoms of said curtain walls are positioned in closely space relation from said ladle so as to reduce the amount of air which is aspirated therebetween.

3. The canopy of claim 1 in which said individual curtain walls are hingedly secured to said frame.

4. The canopy of claim 1 which includes a releasable seal means on said duct for releasably and sealably connecting said duct to a stationary exhaust conduit.

5. The canopy of claim 1 in which said frame is supported in cantilever fashion over said ladle.

6. A pouring assembly comprising a ladle for receiving molten metal, and a canopy positioned over said ladle for venting gases therefrom, said canopy comprising a frame, a plurality of curtain walls supported in side-by-side relation by said frame in vertically spaced relation from said ladle to provide a space circumscribed by said walls into which gases are vented from said ladle, a rigid discharge conduit, coupling means for releasably communicating the space within said canopy to said discharge conduit, and means for pivoting said canopy into and away from overlying relation with respect to said ladle.

7. The pouring assembly of claim 6 in which said coupling means includes means for sealingly connecting said canopy to said discharge conduit.

* * * * *